US005370245A

United States Patent [19]

Tersch et al.

[11] Patent Number: 5,370,245

[45] Date of Patent: Dec. 6, 1994

[54] WATER COOLER BOTTLE STORAGE STAND AND SYSTEM

[75] Inventors: James R. Tersch, Lauderdale by the Sea; Robert J. Tersch, Pompano Beach, both of Fla.; Jeffrey W. Rosania, Bloomsbury, N.J.

[73] Assignee: The Bottle Buddy, Inc., Fort Lauderdale, Fla.

[21] Appl. No.: 75,112

[22] Filed: Jun. 11, 1993

Related U.S. Application Data

[63] Continuation-in-part of Ser. No. 863,725, Apr. 3, 1992, Pat. No. D. 336,408.

[51] Int. Cl.[5] ..... A47F 7/00

[52] U.S. Cl. ..... 211/74; 211/194; 248/150

[58] Field of Search ..... 211/59.4, 194, 71, 74, 211/189; 248/150, 129, 146, 188.8, 188.9, 151

[56] References Cited

U.S. PATENT DOCUMENTS

| | | | |
|---|---|---|---|
| D. 210,735 | 4/1968 | Magistretti . | |
| D. 233,817 | 12/1974 | Mathews et al. . | |
| D. 234,894 | 4/1975 | Vandenbeuck . | |
| D. 236,411 | 8/1975 | Horney . | |
| D. 270,881 | 10/1983 | Zaro . | |
| D. 273,929 | 5/1984 | Rolli, Jr. . | |
| D. 288,156 | 2/1987 | Nuncio . | |
| D. 321,296 | 11/1991 | Miranda . | |
| D. 329,963 | 10/1992 | Schneider . | |
| 1,608,552 | 11/1926 | Ellis | 248/129 |
| 2,746,703 | 5/1956 | Emery | 248/150 |
| 2,846,078 | 8/1958 | Shelby | 248/150 |
| 2,916,161 | 12/1959 | Shaefer . | |
| 2,966,322 | 12/1960 | Robinson | 248/150 |
| 3,053,397 | 9/1962 | Bliss . | |
| 3,559,812 | 2/1971 | Wolf et al. . | |
| 3,581,907 | 6/1971 | Schmidt . | |
| 3,606,023 | 9/1971 | Edmunds . | |
| 4,093,076 | 6/1978 | Newton . | |
| 4,175,666 | 11/1979 | Smith | 211/71 |
| 4,270,662 | 6/1981 | Gonzalez . | |
| 4,431,107 | 2/1984 | Bergstrom et al. . | |
| 4,442,991 | 4/1984 | Levens | 248/146 |
| 4,506,796 | 3/1985 | Thompson . | |
| 4,898,282 | 2/1990 | Hawkinson et al. | 211/59.3 X |
| 4,930,643 | 6/1990 | Flum . | |
| 4,940,150 | 7/1990 | Spengler . | |
| 4,998,023 | 3/1991 | Kitts . | |
| 5,048,702 | 9/1991 | Maloney . | |

*Primary Examiner*—Robert W. Gibson, Jr.
*Attorney, Agent, or Firm*—Wigman, Cohen, Leitner & Myers

[57] ABSTRACT

A modular system for holding water cooler bottles on their sides so as to be easily stored and readily accessible for removal and placement in a water cooler. The present invention is an integrally formed molded plastic bottle holder unit which is vertically stackably interconnectable and horizontally interconnectable to form a bottle holder system. Each unit has four vertical supports. Two parallel horizontal supports are provided, each integrally formed with and connecting a pair of vertical supports. These pairs of connected vertical supports are connected by two horizontal supports each shaped and arcuately contoured to support the curved side of a water bottle. An integrally formed horizontal support member extends between the two contoured horizontal support members substantially parallel to the bottle longitudinal axis. Each vertical support has an upper and lower end which are open and form a receiving cavity for either an end cap, a caster holder, a transition element between two stacked bottle units or a connector or connector caster member for connecting two or more horizontally adjacent bottle units. The individual connectors, caster holders, end caps or transition elements each have wedging surfaces integrally formed in the faces of the sides thereof.

55 Claims, 4 Drawing Sheets

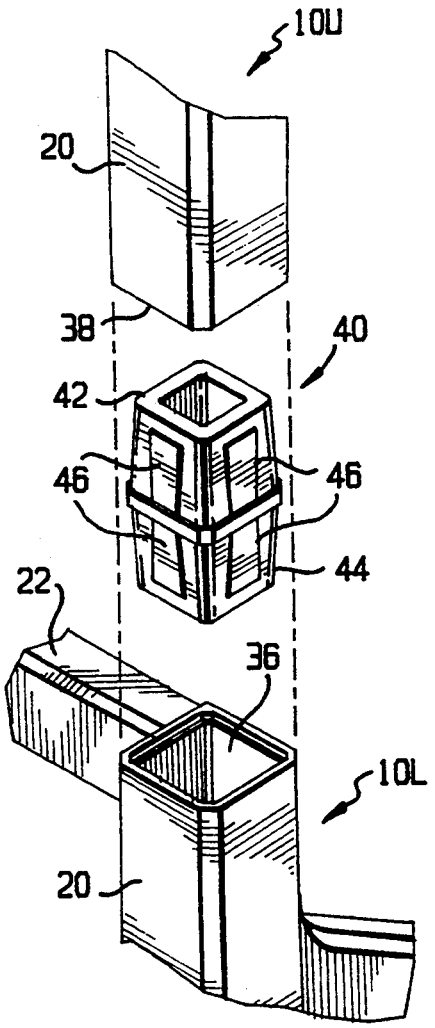
FIG. 5
FIG. 6
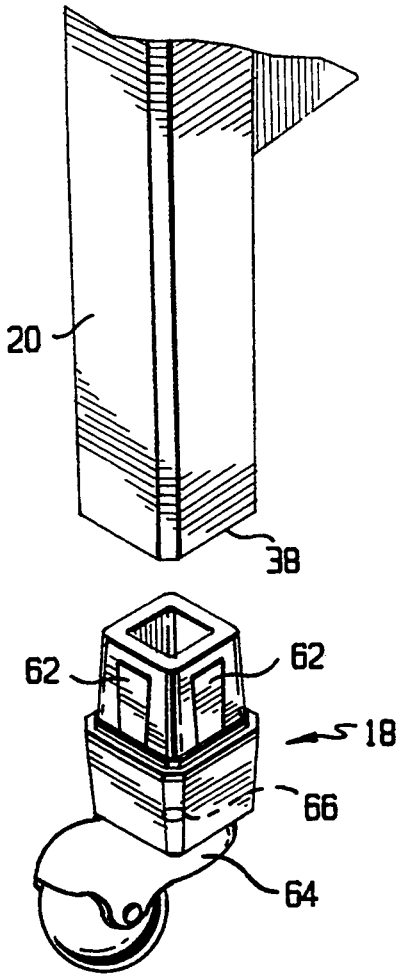
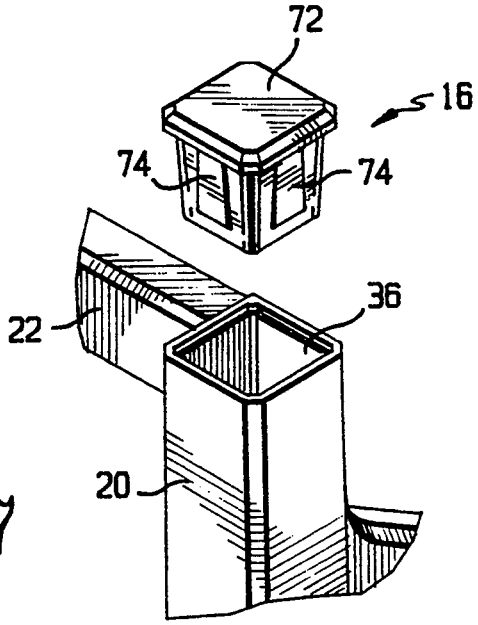
FIG. 7

WATER COOLER BOTTLE STORAGE STAND AND SYSTEM

RELATED APPLICATIONS

This application is a continuation-in-part application of design patent application Ser. No. 07/863,725, filed Apr. 3, 1992, and issued Jun. 15, 1993 as design Pat. No. D336,408.

FIELD OF INVENTION

The present invention relates to a modular water cooler bottle storage system. More particularly, the invention relates to a water cooler bottle storage system which is comprised of vertically stackable and interconnectable bottle stands which are also horizontally interconnectable.

BACKGROUND OF THE INVENTION

The storage of filled water cooler bottles before use and the subsequent storage of empty water bottles after use poses a problem of ready access and esthetic appearance. Filled water bottles are sometimes delivered to users as individual bottles, or alternatively, in stackable crate-like holders. Such crates are not interconnected and hence are easily slidable relative to one another. In addition, such holders are unsightly and are frequently relegated to closets and other storage areas remote from the location of the water cooler. This results in full (and hence heavy) water bottles having to be moved from their place of storage to the water cooler location. Similarly, the empty bottles must be moved back to the storage area.

It is desirable, therefore, to have a bottle storage system which can be located next to the water cooler, is easily assembled, is readily transportable, is attractive in appearance, and is versatile in arrangement in various configurations to hold an appropriate number of full and empty bottles.

SUMMARY OF THE INVENTION

The present invention is directed to a versatile modular system for holding water cooler bottles on their sides so as to be easily stored and readily accessible for removal and placement in a water cooler. The present invention is an integrally formed molded plastic bottle holder unit which is vertically stackably interconnectable and horizontally interconnectable to form a bottle holder system. Each unit has four vertical supports. Two parallel horizontal supports are provided, each integrally formed with and connecting a pair of vertical supports. These pairs of connected vertical supports are connected by two horizontal supports each shaped and arcuately contoured to support a portion or arc length of the curved side of a water bottle. An integrally formed horizontal support member extends between the two contoured horizontal support members substantially parallel to the bottle longitudinal axis. Each vertical support has an upper and lower end which are open and form a receiving cavity for a variety of male members. Such male members include an end cap, a caster holder, a transition element for interconnecting two stacked bottle units, a dual end cap connector or dual connector caster member, which dual end cap connector or dual connector caster member is for connecting two or more horizontally adjacent bottle units. The individual connectors, caster holders, end caps or transition elements each have wedging surfaces integrally formed in the faces of the sides thereof. The preferred embodiment is for frustopyramidal shaped male members. Alternatively, it is contemplated that circular or polygonal cross-sectioned male members can be used, with correspondingly shaped receiving cavities.

The modular nature of the individual storage units coupled with the various connecting elements permits versatility in assembling vertical and horizontal configurations of water bottle storage systems.

With the foregoing and other advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 5 is a partially exploded view of a transition element for vertically connecting two bottle storage stands to be stacked one upon the other;

FIG. 6 is a partially exploded view of a caster element to be mated with a vertical support of a bottle storage stand;

FIG. 7 is a partially exploded view of an end cap to be mated with a vertical support of a bottle storage stand;

DETAILED DESCRIPTION OF THE INVENTION

Figure 1:
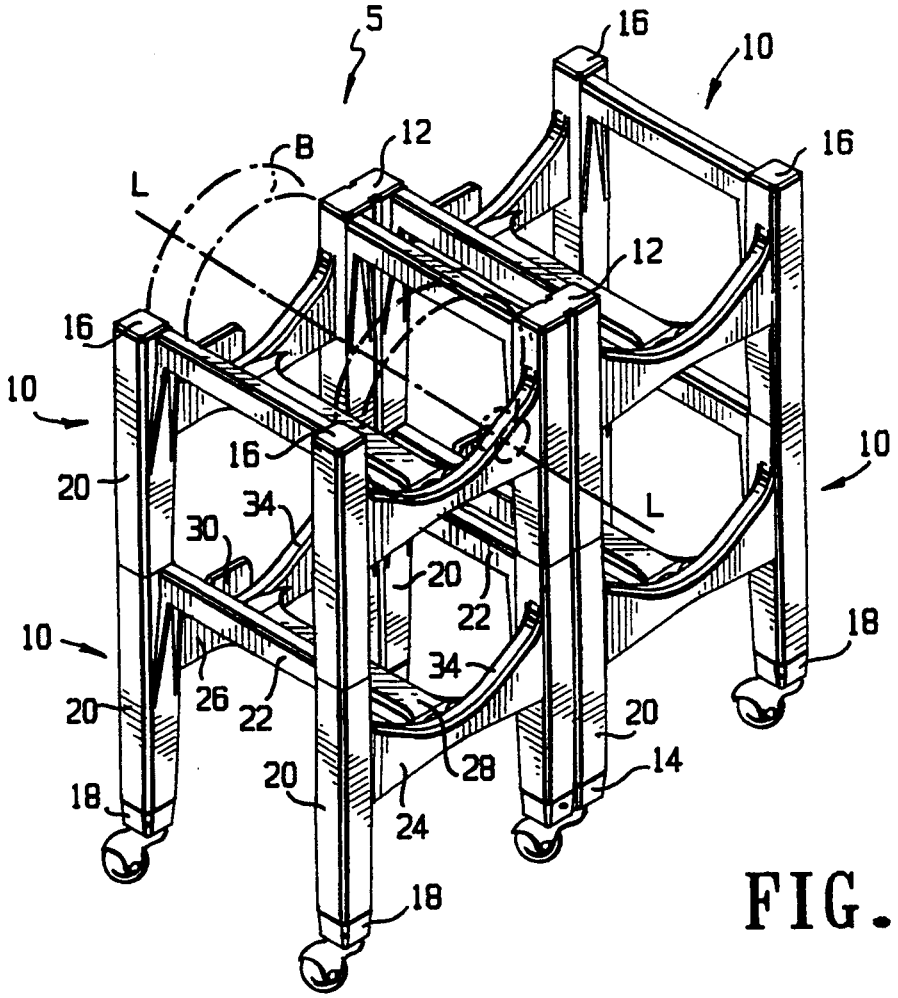
FIG. 1 is a perspective view of a water bottle storage system in accordance with the present invention, showing vertically stacked and interconnected and horizontally connected individual bottle storage stands.

Referring now to the drawings in detail, there is illustrated in FIG. 1 a perspective view showing a system, designated generally by the numeral 5, of vertically stackable and interconnectable and horizontally connectable bottle storage stands, each designated generally by the numeral 10. A bottle B is shown in phantom, stored horizontally on one of the stands 10. As described in further detail below, each bottle storage stand 10 is preferably integrally formed as a unitary member of a suitable material such as molded plastic. Each bottle storage stand 10 can be used alone to hold a single bottle. Alternatively, each bottle storage stand 10 is adapted to receive transition elements (FIG. 5) for connecting vertically stacked bottle storage stands and also adapted to receive dual end cap connectors 12 and dual caster connectors 14 for connecting horizontally adjacent bottle storage stands. Each bottle storage stand 10 is also adapted to receive end caps 16 and casters 18. As shown in FIG. 1, a system can be assembled having four individual bottle storage stands 10 interconnectably arranged in two horizontal rows and two vertical columns. Alternatively, a system can be arranged of only a vertical stack of storage stands. Similarly, a system can be assembled of only horizontally interconnected storage stands. Of course, other interconnected arrangements of multiple rows or columns of stands are contemplated.

Figure 2:
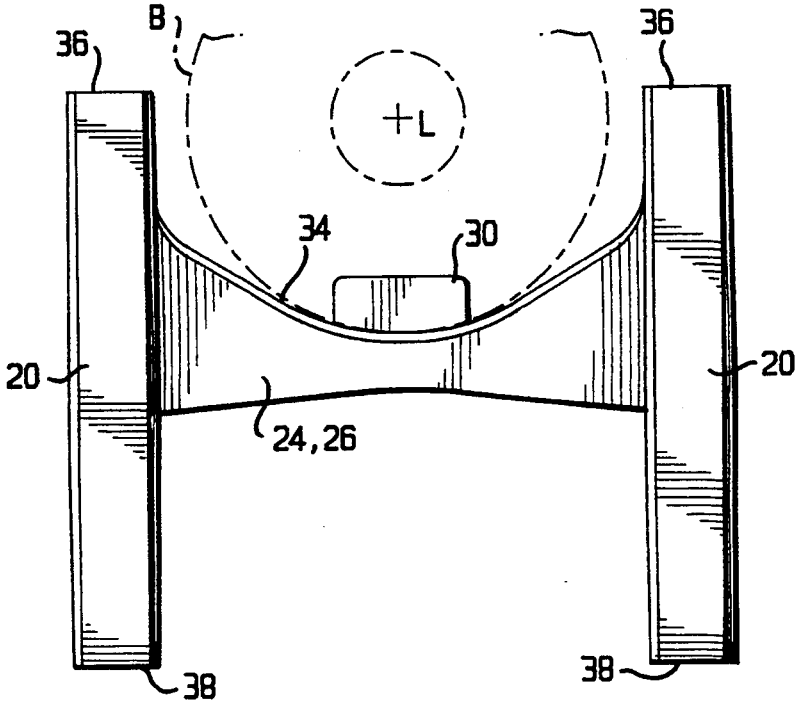
FIG. 2 is a front elevation view of an individual bottle storage stand according to the present invention.
Figure 3:
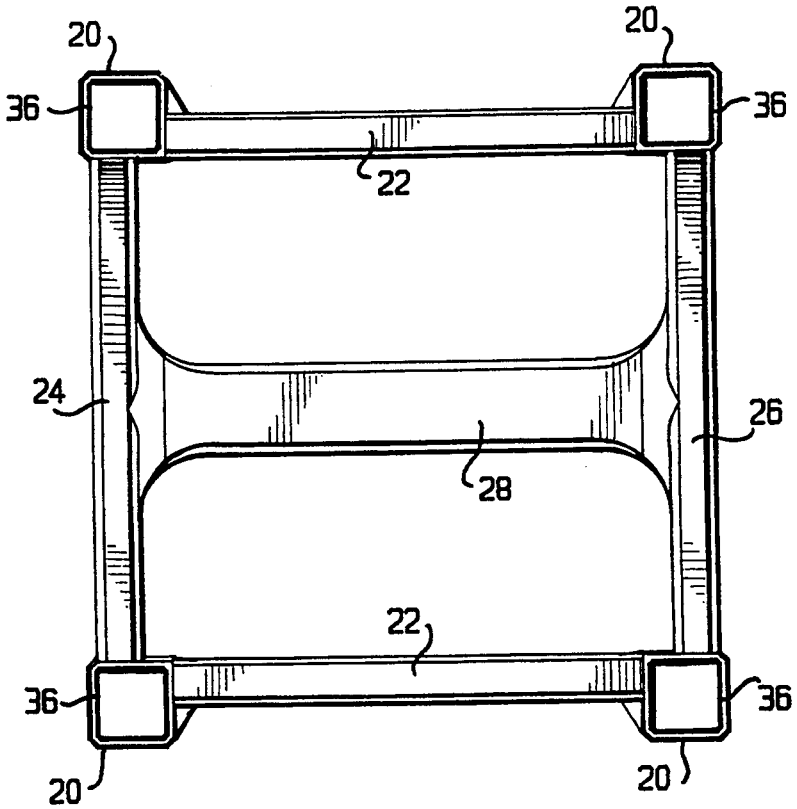
FIG. 3 is a top plan view of an individual bottle storage stand according to the present invention.
Figure 4:
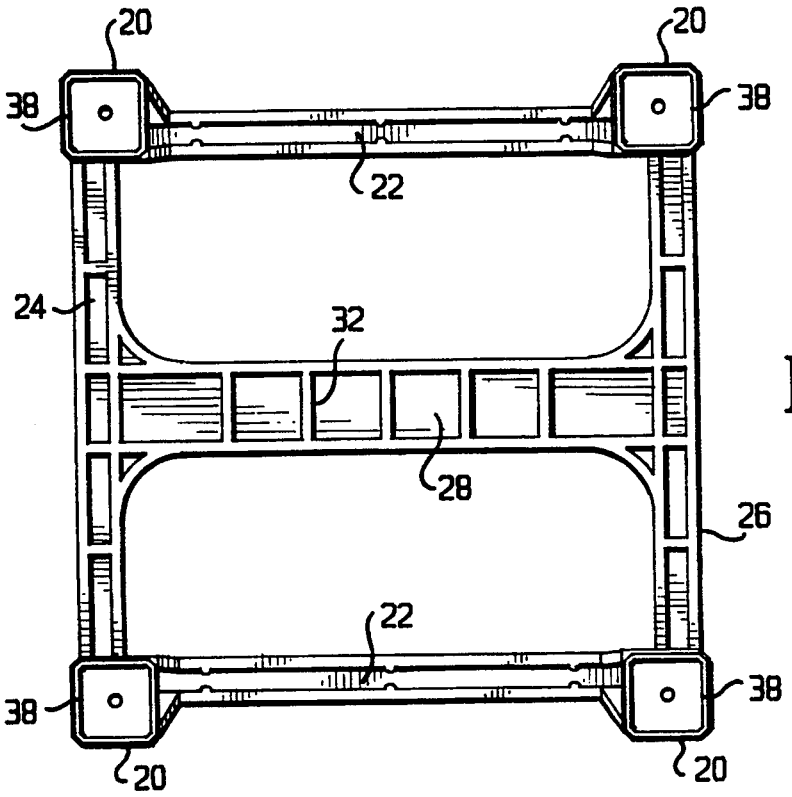
FIG. 4 is a bottom plan view of an individual bottle storage stand according to the present invention.

FIGS. 2–4 illustrate the details of each individual bottle storage stand 10. Four vertical supports or legs 20 are provided. The legs 20 are connected by two horizontal supports 22 which are arranged substantially parallel to the longitudinal axis L of a bottle B to be placed in the bottle storage stand 10. A front support 24 and a rear support 26 are provided for cradling the bottle. A longitudinal support 28 connects front support 24 and rear support 26. A stop or tab 30 is provided on rear support 26 to limit rearward movement for the water bottle. As shown in FIG. 4, webbing or bracing 32 is provided in the underside of longitudinal support 28, front support 24 and rear support 26. Front support 24 and rear support 26 each have an arcuately formed concave surface 34 which conforms to the contours of the side of a water bottle to be supported or cradled therein. Top socket cavities 36 and bottom socket cavities 38 are provided in vertical supports or legs 20. These socket cavities 36, 38 are adapted to receive transition elements, connectors, casters, caster connectors, or end caps, as described below, to permit the vertical stacking and interconnection and horizontal interconnection as described for FIG. 1 above.

The dimensions of the legs 20 and the front and rear support 24, 26 locations permit the bottle to be stored in the space between the front and rear supports of a stand stacked vertically above the stand on which the bottle is stored. Inherent in this feature is the elevation of the center of gravity of the bottle B, thus reducing the amount of bending over required to lift a full bottle in removing it from a stand.

FIGS. 5–10 show the various male elements which engage the socket cavities 36, 38 to affect vertical connection, horizontal connection, end closure or permit rolling of the system, as appropriate.

Figure 10:
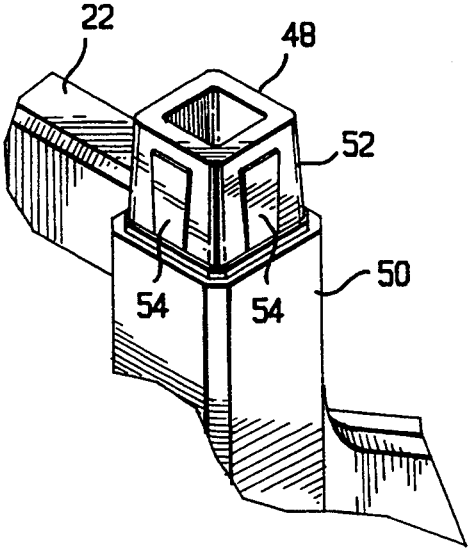
FIG. 10 is a partial perspective view of an integrally formed transition element for vertically connecting bottle storage stands.

FIG. 5 illustrates a transition element 40 which engages a top socket cavity 36 of a lower bottle storage stand 10L and a bottom socket cavity 38 of an upper bottle storage stand 10U. Transition element 40 is essentially shaped as two mirrored frustopyramids (frustum of a pyramid) 42, 44. Each of the four sides of each frustopyramid 42 or 44 has a wedging surface 46 formed therein. Wedging surface 46 is essentially rectangular in shape and raised sufficiently from the respective surface 42, 44 so as to engage in a wedging fit with the socket cavity 36, 38 to which it is mated. As a result, a firm connection is formed between vertically stacked bottle storage stands 10. FIG. 10 shows a transition element 48 which is integrally formed with a vertical support 50. Thus, only one frustopyramid 52 is required, having four wedging surfaces 54, identical to wedging surfaces 46. As shown in FIG. 10, the integrally formed transition element 48 is formed at the top of a vertical support 50. However, the transition element 48 could also be integrally formed at the bottom of the vertical support 50. For an integrally formed transition element 48, the end caps, casters, connectors and connector casters described herein would be modified to fit over or fit into transition element 48.

FIG. 6 shows a caster 18 (FIG. 1), formed as a frustopyramid substantially the same as that for transition element 48, having wedging surfaces 62 substantially the same as wedging surfaces 46. A caster roller 64, as known in the art, is provided, engaging hole 66 in caster 18. The engagement of caster 60 with socket cavity 38 is substantially the same as for transition element 48.

FIG. 7 shows an end cap 16 (FIG. 1) having a frustopyramidal shape, with end 72 and wedging surfaces 74 for engaging socket cavity 36.

Figure 8:
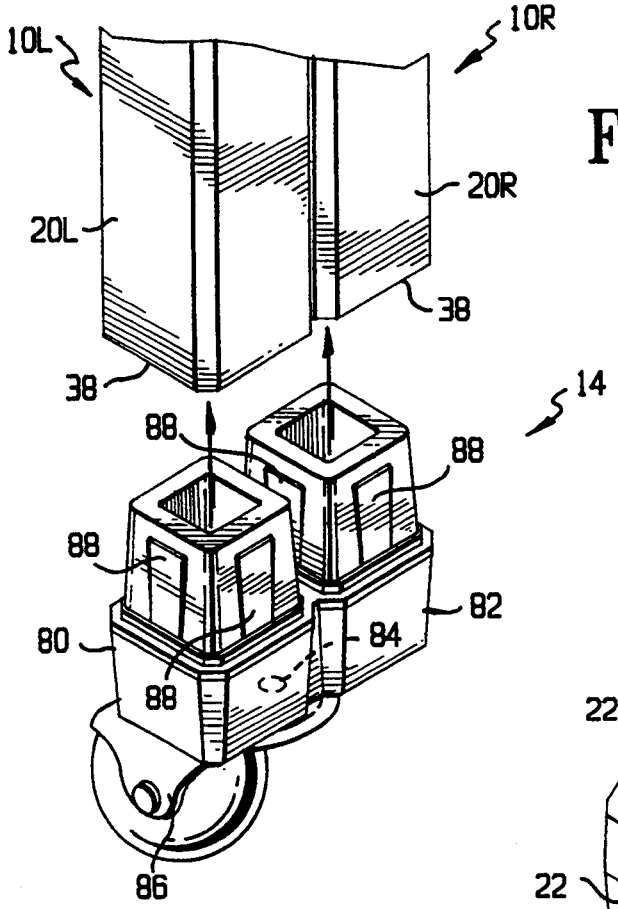
FIG. 8 is a partially exploded view of a caster connector element to be mated with the vertical supports of two horizontally adjacent bottle storage stands.
Figure 9:
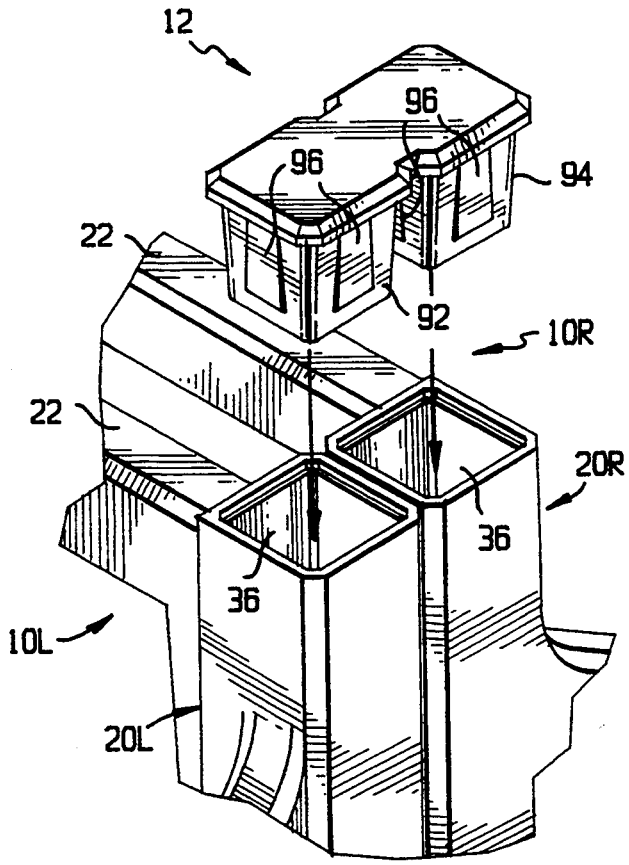
FIG. 9 is a partially exploded view of an end cap connector element to be mated with the vertical supports of two horizontally adjacent bottle storage stands.

FIG. 8 and 9 show connecting elements for effecting the connection between horizontally adjacent bottle storage stands. Specifically, FIG. 8 shows dual caster connector 14 comprising two connectors 80, 82 formed integrally and having a hole 84 for receiving a single caster roller 86. Similarly to the individual caster 18, each connector 80, 82 of dual caster connector 14 is frustopyramidal in shape, having wedging surfaces 88 formed therein. Dual connectors 80, 82 each engage bottom socket cavities 38 of horizontally adjacent vertical supports or legs 20L, 20R.

FIG. 9 illustrates a dual end cap connector 12 (FIG. 1), having two frustopyramids 92, 94, with each having wedging surfaces 96. Dual end cap connector 12 engages top socket cavities 36 of horizontally adjacent vertical supports or legs 20L, 20R of horizontally adjacent bottle storage stands 10L, 10R.

The components described in FIGS. 2–9 can be assembled into a variety of system configurations, depending upon user needs. An individual stand 10 can be used without any connectors, end caps or casters as a stand alone system to hold a single bottle. A vertical stack of interconnected bottle stands can be assembled by using transition elements 40 to connect the individual stands 10, with individual casters 18 being used on the bottom stand 10, with end caps 16 being used on the top stand 10. Given the typical water cooler bottle dimensions, a vertical stack system would likely comprise approximately four individual interconnected stands 10. Alternatively, a one row horizontal system can be assembled having a series of horizontally interconnected adjacent stands 10. In such a configuration, the stands 10 would be connected by dual caster connectors 14 at the bottom and dual end cap connectors 12 at the top. As appropriate, individual casters 18 and individual end caps 16 would be used. Multiple row and column systems, such as shown in FIG. 1, can be assembled using appropriate male members for connecting the individual stands 10. Finally, a stationary system is contemplated, in which, regardless of the configuration, the caster rollers are removed and only the remaining portions are used as bottom end caps. Thus, one skilled in the art will recognize the versatility of the present invention.

The male members and the corresponding female socket cavities described herein can be of different cross-section and shape than described herein. For example, circular or polygonal cross-sections are contemplated in addition to the frustopyramidal shape of the preferred embodiment.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A water bottle storage unit for holding a water cooler bottle placed substantially horizontally thereon, comprising:

means for holding said water bottle, said holding means contoured to conform to the water cooler bottle and including a longitudinal member for supporting the bottle along an underside thereof;

means for supporting said holding means attached to said holding means, said support means adapted to be interconnected with one or more similar said storage units.

2. A water bottle storage unit as in claim 1, wherein said supporting means includes a plurality of substantially vertical supports.

3. A water bottle storage unit as in claim 2, wherein each said vertical support has a socket cavity formed in the bottom thereof.

4. A water bottle storage unit as in claim 2, wherein each said vertical support has a socket cavity formed in the top thereof.

5. A water bottle storage unit as in claim 2, wherein each said unit is adapted to be vertically connected to a similar storage unit by means of a male transition element.

6. A water bottle storage unit as in claim 2, wherein each said unit is adapted to receive a connector for horizontally connecting said units, said connector comprising a pair of horizontally adjacent connected frustopyramids having wedging surfaces formed on the faces thereof for engaging socket cavities in said vertical supports.

7. A water bottle storage unit as in claim 2, wherein each said unit has a frustopyramid shaped transition element formed integrally with the top of each said vertical support for engaging a socket cavity in the bottom of a storage unit to be stacked vertically thereon.

8. A water bottle storage unit as in claim 2, wherein each said unit has a frustopyramid shaped transition element formed integrally with the bottom of each said vertical support for engaging a socket cavity in the top of a storage unit upon which said unit is to be vertically stacked.

9. A water bottle storage unit as in claim 2, further comprising an end cap for engaging a socket cavity in the top of each said vertical support.

10. A water bottle storage unit as in claim 2, further comprising a pair of frustopyramidal shaped elements connected horizontally for engaging socket cavities in adjacent said units.

11. A water bottle storage unit as in claim 2, further comprising a caster for engaging a bottom socket cavity of a vertical support, said caster comprising a roller disposed within a frustopyramidal shaped member having a plurality of wedging surfaces formed thereon.

12. A water bottle storage system for holding a plurality of water cooler bottles, each said bottle placed substantially horizontally thereon, comprising:

a plurality of water bottle storage units, each including:

means for holding a water bottle, said holding means contoured to conform to the water cooler bottle and including a longitudinal member for supporting the bottle along the underside thereof, means for supporting said holding means attached to said holding means, and means for connecting said plurality of water bottle storage units, said connecting means connecting said units in a configuration selected from the group of configurations consisting of vertically connected units, horizontally connected units and vertically and horizontally connected units.

13. A water bottle storage system as in claim 12, wherein said supporting means includes a plurality of substantially vertical supports.

14. A water bottle storage system as in claim 13, wherein each said vertical support has a socket cavity formed in the bottom thereof.

15. A water bottle storage system as in claim 13, wherein each said vertical support has a socket cavity formed in the top thereof.

16. A water bottle storage system as in claim 13, wherein each said unit is adapted to be vertically connected to a similar storage unit by means of a male transition element.

17. A water bottle storage system as in claim 13, wherein each said unit is adapted to receive a connector for horizontally connecting said units, said connector comprising a pair of horizontally adjacent connected frustopyramids having wedging surfaces formed on the faces thereof for engaging socket cavities in said vertical supports.

18. A water bottle storage system as in claim 13, wherein each said unit has a frustopyramid shaped transition element formed integrally with the top of each said vertical support for engaging a socket cavity in the bottom of a storage unit to be stacked vertically thereon.

19. A water bottle storage system as in claim 13, wherein each said unit has a frustopyramid shaped transition element formed integrally with the bottom of each said vertical support for engaging a socket cavity in the top of a storage unit upon which said unit is to be vertically stacked.

20. A water bottle storage system as in claim 13, further comprising an end cap for engaging a socket cavity in the top of each said vertical support.

21. A water bottle storage system as in claim 13, further comprising a pair of frustopyramidal shaped elements connected horizontally for engaging socket cavities in adjacent said units.

22. A water bottle storage system as in claim 13, further comprising a caster for engaging a bottom socket cavity of a vertical support, said caster comprising a roller disposed within a frustopyramidal shaped member having a plurality of wedging surfaces formed thereon.

23. A water bottle storage unit as in claim 1, wherein said supporting means are adapted to be interconnected by male members having cross-sections selected from the group of cross-sections consisting of circular and polygonal cross-sections.

24. A water bottle storage system as in claim 12, wherein said connecting means comprise male members having cross-sections consisting of circular and polygonal cross-sections.

25. A water bottle storage unit for holding a water cooler bottle placed substantially horizontally thereon, comprising:

means for holding said water bottle, said holding means including:

a pair of substantially horizontal supports, each said support connecting a pair of said vertical supports, a pair of substantially horizontal bottle supports, one said support connected to a pair of vertical supports at the front of said bottle storage unit, the other said support connected to a pair of vertical supports at the back of said bottle storage unit, and a longitudinal support connecting said horizontal bottle supports;

means for supporting said holding means attached to said holding means, said supporting means including a plurality of substantially vertical supports;

said supporting means adapted to be interconnected with one or more similar said storage units.

26. A water bottle storage unit as in claim 25, further comprising a stop formed on said back horizontal support member.

27. A water bottle storage unit as in claim 25, wherein said horizontal support members each have an arcuately formed portion for cradling the bottle therein.

28. A water bottle storage unit for holding a water cooler bottle placed substantially horizontally thereon, comprising:

means for holding said water bottle;

means for supporting said holding means attached to said holding means, said supporting means adapted to be interconnected with one or more similar said storage units, wherein said unit is integrally formed as a single unitary structure.

29. A water bottle storage unit for holding a water cooler bottle placed substantially horizontally thereon, comprising:

means for holding said water bottle;

means for supporting said holding means attached to said holding means, said supporting means including a plurality of substantially vertical supports;

said supporting means adapted to be interconnected with one or more similar said storage units, wherein each said unit is adapted to be vertically connected to a similar storage unit by means of a male transition element shaped as a mirrored frustopyramid, having a plurality of wedging surfaces formed on the faces of said mirrored frustopyramid, said wedging surfaces for engaging socket cavities in said vertical supports.

30. A water bottle storage unit for holding a water cooler bottle placed substantially horizontally thereon, comprising:

means for holding said water bottle;

means for supporting said holding means attached to said holding means, said supporting means including a plurality of substantially vertical supports;

said supporting means adapted to be interconnected with one or more similar said storage units, wherein each said unit is adapted to receive a connector caster for horizontally connecting said units, said connector caster comprising a pair of horizontally adjacent connected frustopyramids having wedging surfaces formed on the faces thereof for engaging socket cavities in the faces of said frustopyramids, and further comprising a roller disposed between said pair of frustopyramids.

31. A water bottle storage system for holding a plurality of water cooler bottles, each said bottle placed substantially horizontally thereon, comprising:

a plurality of water bottle storage units, each including:

means for holding a water bottle, said holding means including:

a pair of substantially horizontal supports, each said support connected to a pair of vertical supports at the front of said bottle storage unit, the other said support connected to a pair of vertical supports at the back of said bottle storage unit, and a longitudinal support connecting said horizontal bottle supports;

means for supporting said holding means attached to said holding means, said supporting means including a plurality of substantially vertical supports; and means for connecting said plurality of water bottle storage units, said connecting means connecting said units in a configuration selected from the group of configurations consisting of vertically connected units, horizontally connected units and vertically and horizontally connected units.

32. A water bottle storage system as in claim 31, further comprising a stop formed on said back horizontal support member.

33. A bottle storage system as in claim 31, wherein said horizontal support members each have an arcuately formed portion for cradling the bottle therein.

34. A water bottle storage system for holding a plurality of water cooler bottles, each said bottle placed substantially horizontally thereon, comprising:

a plurality of water bottle storage units, each said unit integrally formed as a single unitary structure, including:

means for holding a water bottle, means for supporting said holding means attached to said holding means, and means for connecting said plurality of water bottle storage units, said connecting means connecting said units in a configuration selected from the group of configurations consisting of vertically connected units, horizontally connected units and vertically and horizontally connected units.

35. A water bottle storage system for holding a plurality of water cooler bottles, each said bottle placed substantially horizontally thereon, comprising:

a plurality of water bottle storage units, each including:

means for holding a water bottle, means for supporting said holding means attached to said holding means, said supporting means including a plurality of substantially vertical supports; and means for connecting said plurality of water bottle storage units, said connecting means connecting said units in a configuration selected from the group of configurations consisting of vertically connected units, horizontally connected units and vertically and horizontally connected units; wherein each said unit is adapted to be vertically connected to a similar storage unit by means of a male transition element shaped as a mirrored frustopyramid, having a plurality of wedging surfaces formed on the faces of said mirrored frustopyramid, said wedging surfaces for engaging socket cavities in said vertical supports.

36. A water bottle storage system for holding a plurality of water cooler bottles, each said bottle placed substantially horizontally thereon, comprising:

a plurality of water bottle storage units, each including:

means for holding a water bottle, means for supporting said holding means attached to said holding means, said supporting means including a plurality of substantially vertical supports; and means for connecting said plurality of water bottle storage units, said connecting means connecting said units in a configuration selected from the group of configurations consisting of vertically connected units, horizontally connected units and vertically and horizontally connected units; wherein each said unit is adapted to receive a connector caster for horizontally connecting said units, said connector caster comprising a pair of horizontally adjacent connected frustopyramids having wedging surfaces formed on the faces thereof for engaging socket cavities in the faces of said frustopyramids, and further comprising a roller disposed between said pair of frustopyramids.

37. A receptacle storage unit for holding a receptacle placed substantially horizontally thereon, comprising:

means for holding said receptacle, said holding means contoured to conform to the receptacle and including a longitudinal member for supporting the receptacle along an underside thereof;

means for supporting said holding means attached to said holding means, said support means adapted to be interconnected with one or more similar said storage units.

38. A receptacle storage unit as in claim 37, wherein said supporting means includes a plurality of substantially vertical supports.

39. A receptacle storage unit as in claim 48, wherein said holding means includes:

a pair of substantially horizontal supports, each said support connecting a pair of said vertical supports, a pair of substantially horizontal receptacle supports, one said support connected to a pair of vertical supports at the front of said receptacle storage unit, the other said support connected to a pair of vertical supports at the back of said receptacle storage unit, and a longitudinal support connecting said horizontal receptacle supports.

40. A receptacle storage unit as in claim 37, wherein said unit is integrally formed as a single unitary structure.

41. A receptacle storage unit as in claim 38, wherein each said vertical support has a socket cavity formed in the bottom thereof.

42. A receptacle storage unit as in claim 38, wherein each said vertical support has a socket cavity formed in the top thereof.

43. A receptacle storage unit as in claim 38, wherein each said unit is adapted to be vertically connected to a similar storage unit by means of a male transition element.

44. A receptacle storage unit as in claim 43, wherein said male transition element is shaped as a mirrored frustopyramid, having a plurality of wedging surfaces formed on the faces of said mirrored frustopyramid, said wedging surfaces for engaging socket cavities in said vertical supports.

45. A receptacle storage unit as in claim 38, wherein each said unit is adapted to receive a connector for horizontally connecting said units, said connector comprising a pair of horizontally adjacent connected frustopyramids having wedging surfaces formed on the faces thereof for engaging socket cavities in said vertical supports.

46. A receptacle storage unit as in claim 38, wherein each said unit is adapted to receive a connector caster for horizontally connecting said units, said connector caster comprising a pair of horizontally adjacent connected frustopyramids having wedging surfaces formed on the faces thereof for engaging socket cavities in the faces of said frustopyramids, and further comprising a roller disposed between said pair of frustopyramids.

47. A receptacle storage unit as in claim 38, wherein each said unit has a frustopyramid shaped transition element formed integrally with the top of each said vertical support for engaging a socket cavity in the bottom of a storage unit to be stacked vertically thereon.

48. A receptacle storage unit as in claim 38, wherein each said unit has a frustopyramid shaped transition element formed integrally with the bottom of each said vertical support for engaging a socket cavity in the top of a storage unit upon which said unit is to be vertically stacked.

49. A receptacle storage unit as in claim 38, further comprising an end cap for engaging a socket cavity in the top of each said vertical support.

50. A receptacle storage unit as in claim 38, further comprising a pair of frustopyramidal shaped elements connected horizontally for engaging socket cavities in adjacent said units.

51. A receptacle storage unit as in claim 38, further comprising a caster for engaging a bottom socket cavity of a vertical support, said caster comprising a roller disposed within a frustopyramidal shaped member having a plurality of wedging surfaces formed thereon.

52. A receptacle storage unit as in claim 39, further comprising a stop formed on said back horizontal support member.

53. A receptacle storage unit as in claim 39, wherein said horizontal support members each have an arcuately formed portion for cradling the receptacle therein.

54. A receptacle storage unit for holding a receptacle placed substantially horizontally thereon, comprising:

means for holding said receptacle, said holding means including:

a pair of substantially horizontal supports, each said support connecting a pair of vertical supports, a pair of substantially horizontal receptacle supports, one said support connected to a pair of vertical supports at the front of said receptacle storage unit, the other said support connected to a pair of vertical supports at the back of said receptacle storage unit, and a longitudinal support connecting said horizontal receptacle supports;

means for supporting said holding means attached to said holding means, said supporting means including a plurality of substantially vertical supports;

said supporting means adapted to be interconnected with one or more similar said storage units.

55. A receptacle storage system for holding a plurality of receptacles, each said receptacle placed substantially horizontally thereon, comprising:

a plurality of receptacle storage units, each including:

means for holding a receptacle, said holding means including:

a pair of substantially horizontal supports, each said support connected to a pair of vertical supports at the front of said receptacle storage unit, the other said support connected to a pair of vertical supports at the back of said receptacle storage unit, and a longitudinal support connecting said horizontal receptacle supports;

means for supporting said holding means attached to said holding means, said supporting means including a plurality of substantially vertical supports; and means for connecting said plurality of receptacle storage units, said connecting means connecting said units in a configuration selected from the group of configurations consisting of vertically connected units, horizontally connected units and vertically and horizontally connected units.

* * * * *